US006905024B1

(12) United States Patent
Cao et al.

(10) Patent No.: US 6,905,024 B1
(45) Date of Patent: Jun. 14, 2005

(54) ANTI-THEFT DISPLAY BOX ASSEMBLY

(75) Inventors: Yuan Cao, Qingdao (CN); Douglas Meunier, Cumberland, RI (US)

(73) Assignee: F.A.F. Incorporated, Greenville, RI (US)

( * ) Notice: Subject to any disclaimer, the term of this patent is extended or adjusted under 35 U.S.C. 154(b) by 0 days.

(21) Appl. No.: 10/664,117

(22) Filed: Sep. 17, 2003

(51) Int. Cl.[7] ..... B65D 73/00
(52) U.S. Cl. ..... 206/461; 206/1.5; 206/806; 70/57.1; 70/63
(58) Field of Search ..... 206/1.5, 6.1, 308.2, 206/387.11, 337, 461, 566, 806, 807; 70/57, 70/57.1, 63

(56) References Cited

U.S. PATENT DOCUMENTS

| | | | | |
|---|---|---|---|---|
| 4,453,743 | A * | 6/1984 | Sanders et al. | 70/57 |
| 4,466,540 | A * | 8/1984 | Lotrous et al. | 206/387.11 |
| 4,469,225 | A * | 9/1984 | Takahashi | 206/1.5 |
| 5,295,576 | A | 3/1994 | Wang | |
| 5,328,137 | A | 7/1994 | Miller et al. | |
| 5,375,712 | A | 12/1994 | Weisburn | |
| 5,740,911 | A | 4/1998 | Chou | |
| 5,823,341 | A * | 10/1998 | Nakasuji | 206/387.11 |
| 5,850,752 | A | 12/1998 | Lax | |
| 5,862,913 | A | 1/1999 | Chou | |
| 5,901,840 | A | 5/1999 | Nakasuji | |
| 6,000,546 | A | 12/1999 | Noble | |
| 6,032,797 | A | 3/2000 | Kao | |
| 6,076,667 | A | 6/2000 | Ambrus | |
| 6,202,454 | B1 | 3/2001 | Nakasuji | |
| 6,374,648 | B1 | 4/2002 | Mitsuyama | |
| 6,430,976 | B1 | 8/2002 | Mitsuyama | |
| 6,467,318 | B1 | 10/2002 | Gattiker | |
| 6,516,639 | B1 | 2/2003 | Eaton et al. | |
| 6,619,079 | B2 * | 9/2003 | Cheung | 206/387.11 |
| 6,694,782 | B2 * | 2/2004 | Mitsuyama | 70/57.1 |
| 2002/0194888 | A1 | 12/2002 | Mitsuyama | |

* cited by examiner

*Primary Examiner*—Luan K. Bui
(74) *Attorney, Agent, or Firm*—Salter & Michaelson

(57) ABSTRACT

A display box includes a housing for supporting a product, a lid, and a removable hanger for locking the lid and housing in a closed position. In the unlocked position, the lid is rotatable relative to the housing along an axis of rotation. A set of cooperating locking members are provided on the lid, housing and hanger. In one embodiment, the housing includes a first locking member in the form of a notch, and the lid includes a second locking member of the same type as the housing. The locking hanger includes a pair of corresponding tabs which are sized to fit within the notches. In use, the tabs are inserted within the notches and slid into a locked position to prevent rotation of the lid. To remove the product from within the locked box the hanger must first be removed from engagement with the lid and housing.

3 Claims, 12 Drawing Sheets

ANTI-THEFT DISPLAY BOX ASSEMBLY

DESCRIPTION

1. Technical Field

The invention relates generally to a display device and, more specifically to an improved display box assembly for displaying a product to a consumer while providing anti-theft protection for the product.

2. Background of Related Art

Many types of display devices have been utilized over the years in order to hold and display numerous products to consumers. For example, it is well known to use display cards to display a variety of consumer products such as jewelry, buttons, hair accessories, and other smaller size products. Display cards are typically hung by retailers on racks, or the like, so that consumers may remove the display card to view the product. One problem associated with display cards is the relative ease of which they can be stolen. In an attempt to prevent such theft, many display cards now carry electronic sensors which trigger an alarm if not removed or disarmed before the product leaves the store. However, such sensors can usually be easily removed. In addition, the products can easily be removed from the card carrying the sensor. One exemplary type of display cards are jewelry display cards. Jewelry display cards may include a generally planar outer surface having a member to secure the article of jewelry thereto, and a hook or aperture for engaging a support member such as a display rack or rod. The securing member may take a variety of forms, depending upon the type of jewelry supported on the display card. Conventional jewelry display cards may include apertures for receiving earrings, pins, etc. and may also include one or more slots for receiving a necklace, bracelet or other items. When a consumer removes the display card it is not difficult to remove the associated piece of jewelry which may be secured in place by nothing more than an electronic sensor sticker.

While generally effective for displaying a variety of products, there currently does not exist a display card or other device which can be utilized to display a product to a consumer in such a manner that the product is clearly visible while also deterring theft of the product in a simple and efficient manner.

SUMMARY

An object of the present invention is to provide a display device which can be utilized to display a product to a consumer on a rod or other support, and which aids in deterring theft of the product displayed therein.

In accordance with one aspect, there is provided a display box assembly including a housing for supporting the product, a lid for accessing the interior of the housing, and a removable hanger for locking the lid and housing in a closed position such that the lid and housing enclose the product within the locked display box. In the unlocked position, the lid is rotatable relative to the housing along an axis of rotation. In order to lock the lid to prevent rotation a set of cooperating locking members are provided. In one embodiment, the housing preferably includes a first locking member in the form of a notch or key hole, and the lid preferably includes a second locking member of the same type as the housing. In this embodiment, the locking hanger preferably includes a pair of corresponding tabs which are sized to fit within the key holes. In order to lock the product within the display box the tabs are inserted within each of the key holes and slid into a locked position so as to prevent rotation of the lid, as described in greater detail below. A sticker may be provided over the portion of the hanger which is removably secured to the case body. Thus, the hanger is not readily removable from the case body and the fact that the hanger is removable is camouflaged by the sticker. To remove the product from within the locked box the hanger must first be removed from engagement with the lid and housing. If a sticker is used, it is first removed, then the tabs of the locking hanger are removed from the key holes in the housing and lid. The lid is then free to rotate into the opened position.

BRIEF DESCRIPTION OF THE DRAWINGS

It should be understood that the drawings are provided for the purpose of illustration only and are not intended to define the limits of the invention. The foregoing and other objects and advantages of the embodiments described herein will become apparent with reference to the following detailed description when taken in conjunction with the accompanying drawings in which.

DETAILED DESCRIPTION OF THE ILLUSTRATIVE EMBODIMENTS

A display box assembly 10 for displaying a product is illustrated in FIGS. 1–19. As used herein, the term "product" refers to any article or item sold to a consumer. Referring to the figures, the box assembly 10 includes a housing 12 which supports the product therein, a lid 14 for accessing the interior of the housing, and a removable hanger 16 which locks the lid together with the housing in a closed position. In order to lock the lid and prevent rotation of the lid into the open position, a set of cooperating locking members are provided on the lid, housing and hanger, as described in greater detail below.

Figure 1:
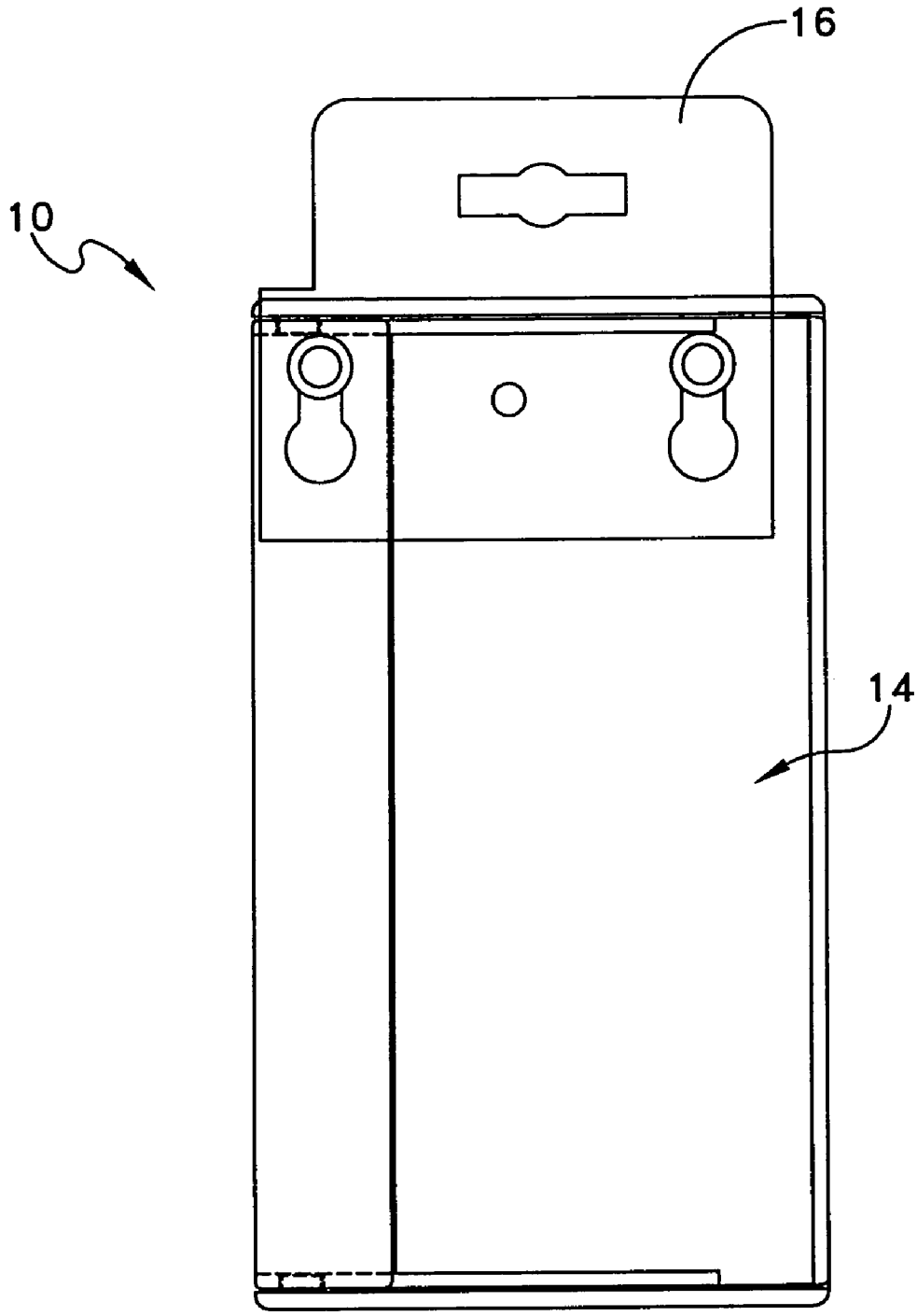
FIG. 1 is a front view of an anti-theft display device in a locked position according to a first embodiment of the present invention.
Figure 2:
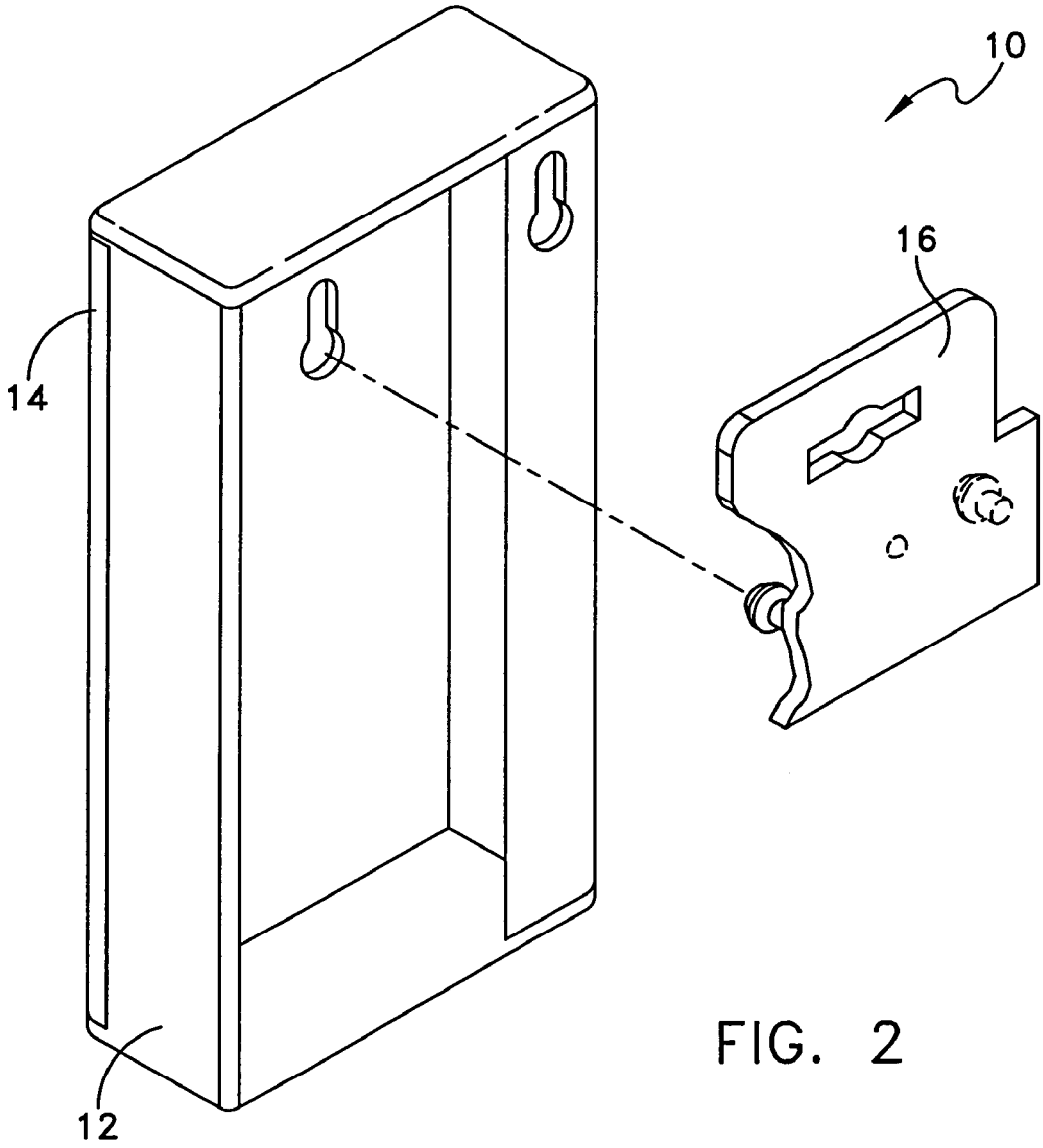
FIG. 2 is an exploded, rear perspective view of the display device of FIG. 1 showing the lid in a closed position with the locking hanger removed.
Figure 3:
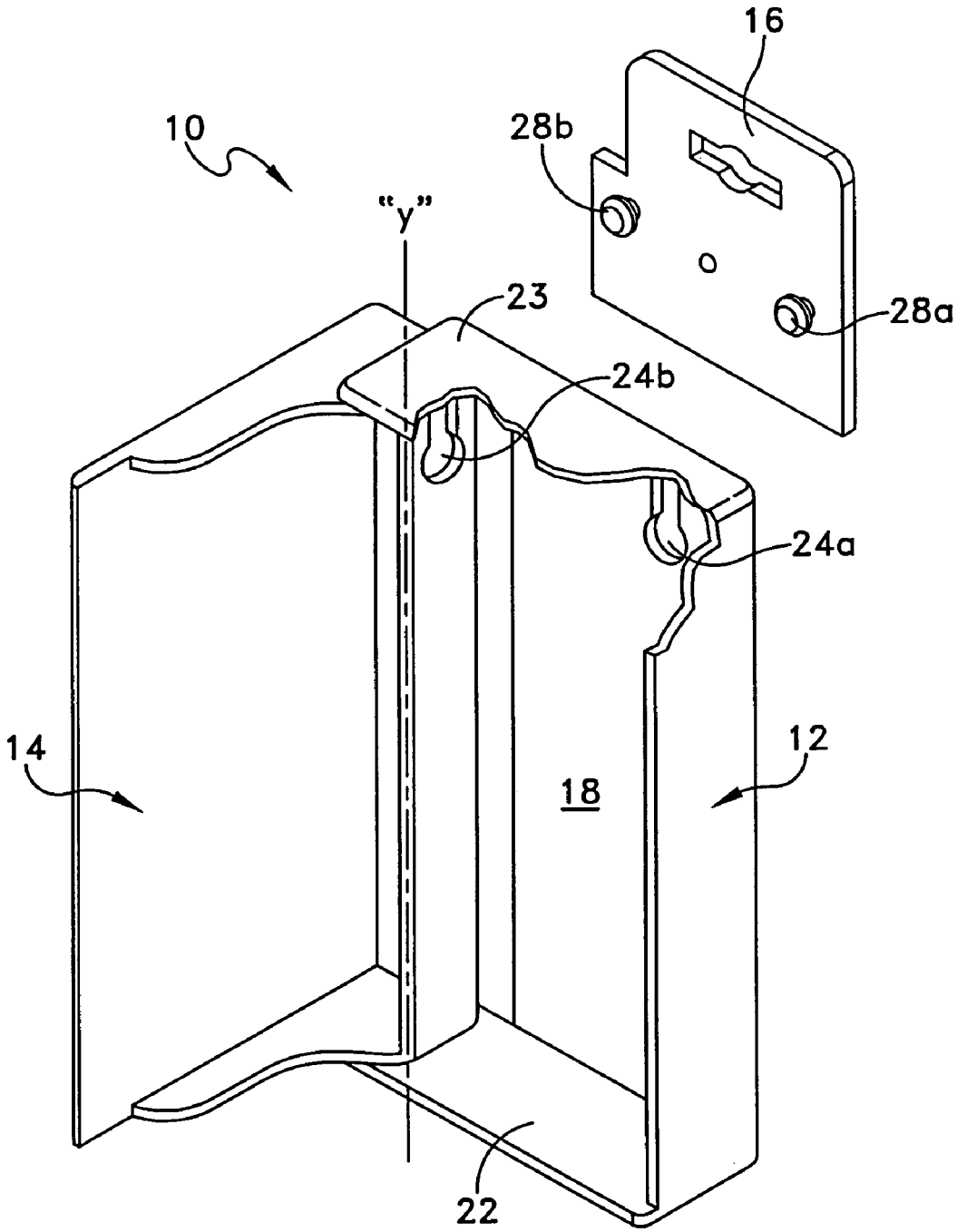
FIG. 3 is an exploded, front perspective view of the cassette body of FIG. 1 in an open or unlocked position, with the locking hanger removed.
Figure 4:
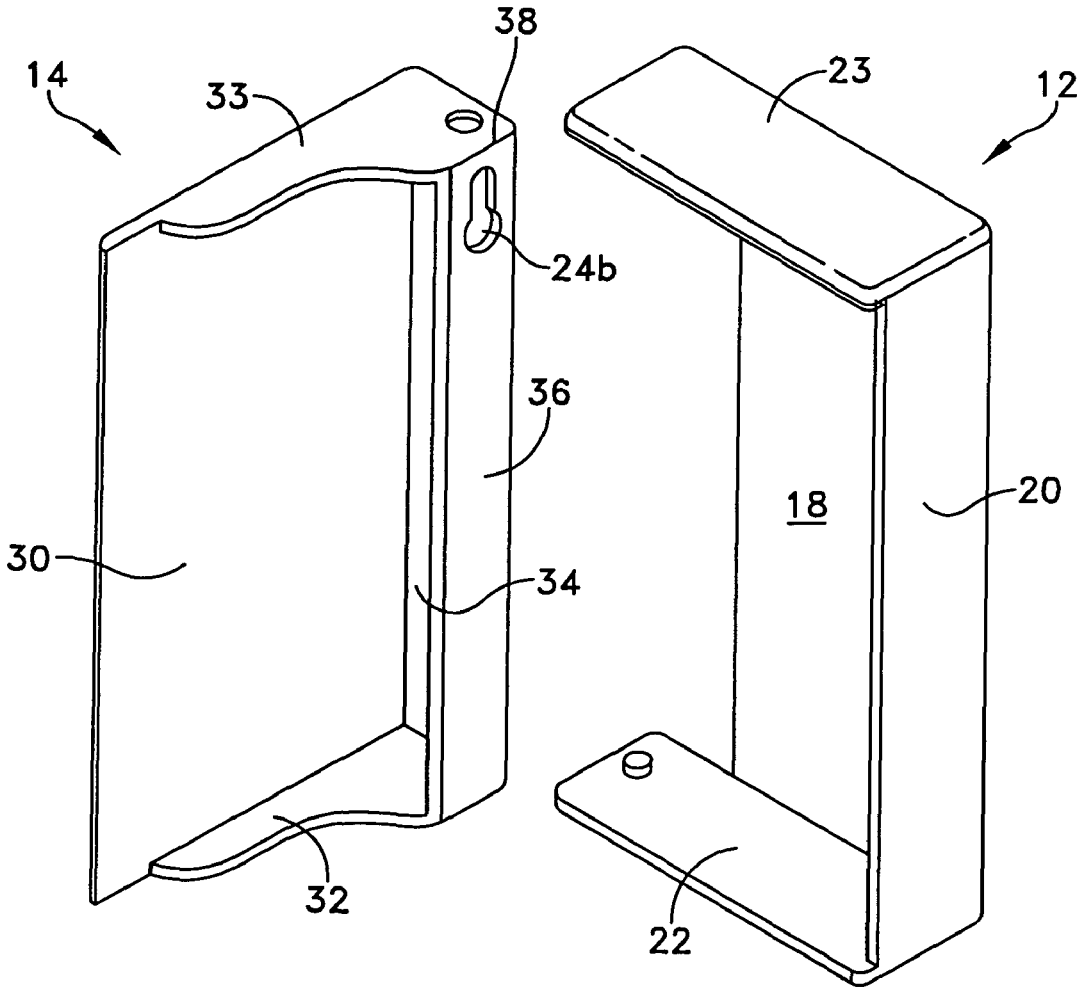
FIG. 4 is an exploded view of the cassette body of FIG. 1.
Figure 5:
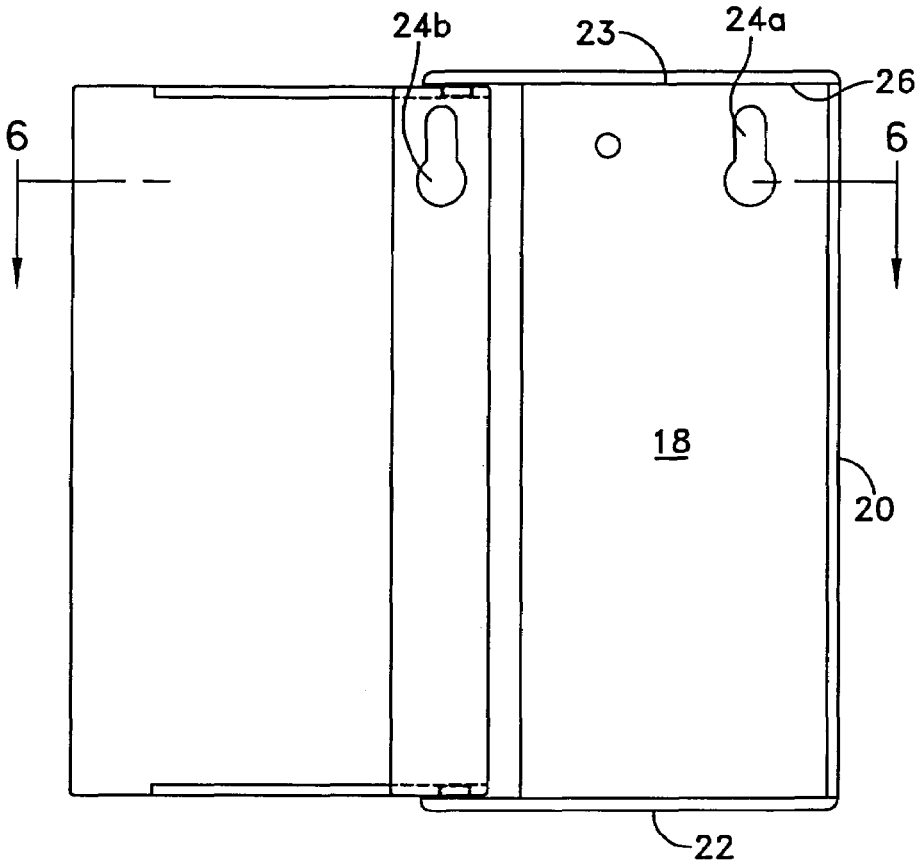
FIG. 5 is a rear, plan view of the cassette body of FIG. 1 in a fully open position.
Figure 6:
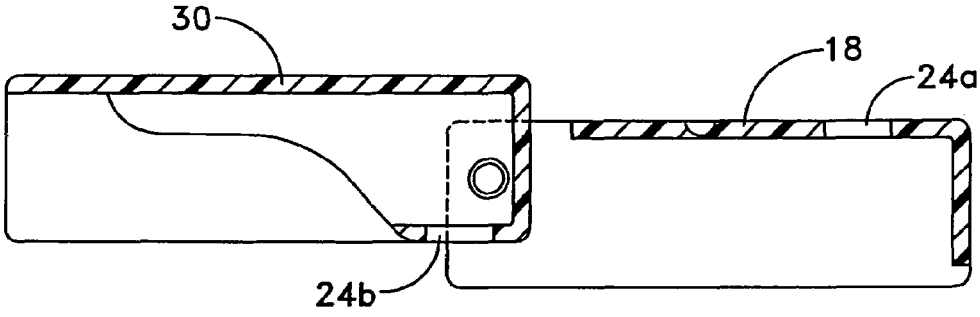
FIG. 6 is an end, cross-sectional view taken along lines 6—6 of FIG. 5 in a first fully open position.
Figure 7:
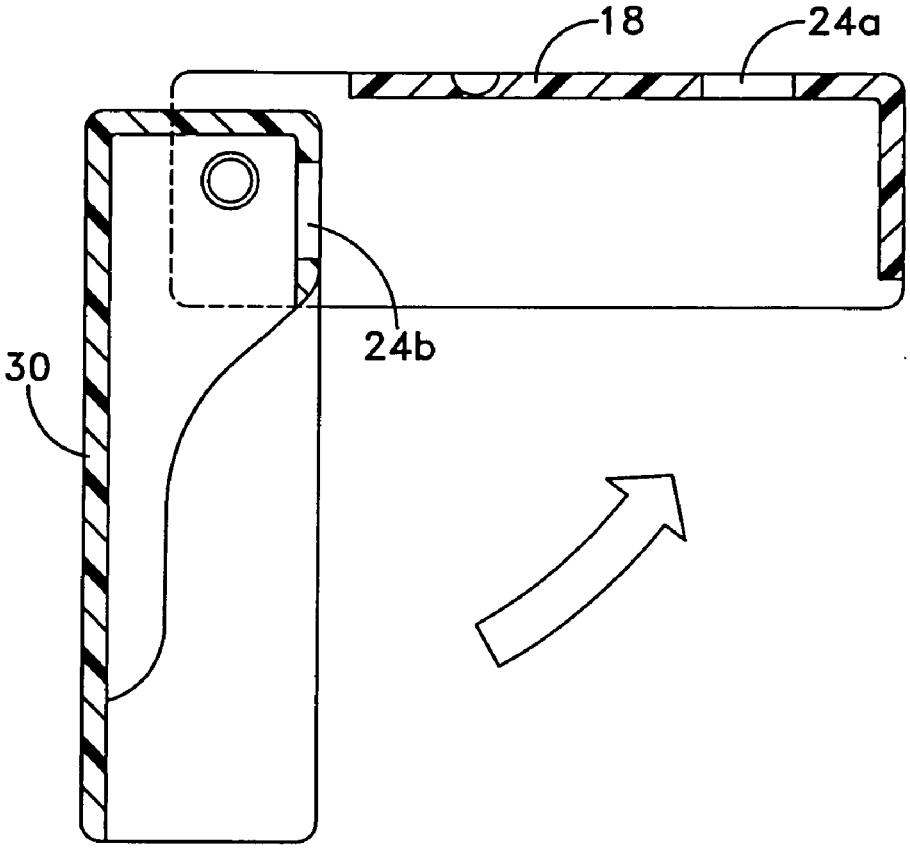
FIG. 7 is an end, cross-sectional view taken along lines 6—6 of FIG. 5 in a second, partially closed position.
Figure 8:
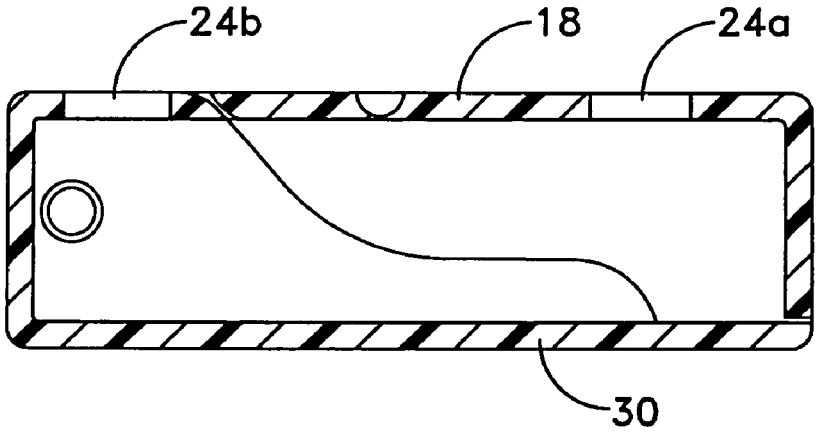
FIG. 8 is a cross-sectional view taken along lines 6—6 of FIG. 5 in a closed position.
Figure 9:
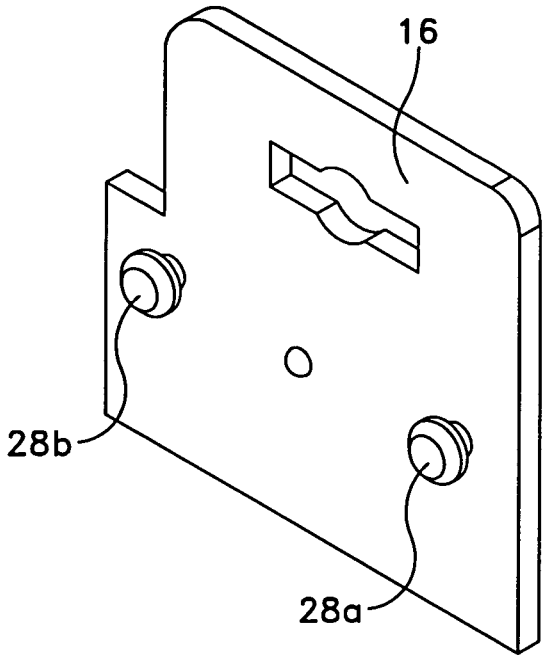
FIG. 9 is a perspective view of the locking hanger of FIG. 1.
Figure 10:
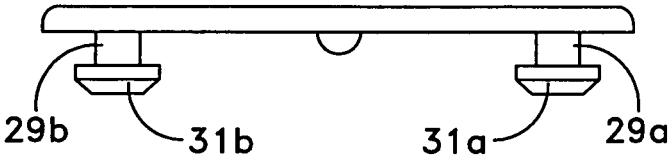
FIG. 10 is a top plan view of the locking hanger of FIG. 9.
Figure 11:
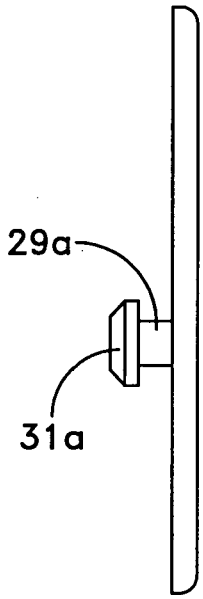
FIG. 11 is a side view of the locking hanger of FIG. 9.
Figure 12:
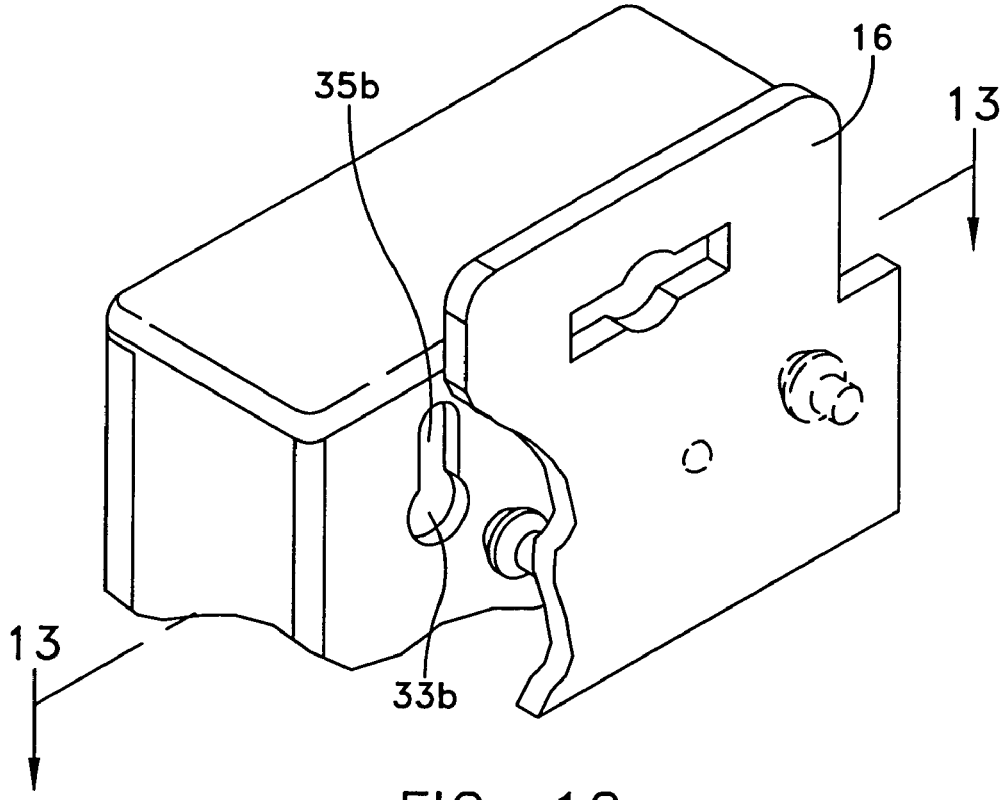
FIG. 12 is an enlarged, rear perspective view, partially broken away of the locking hanger and housing not engaged.

As best seen in FIG. 4, the housing preferably includes a base 18, a front wall 20, and a pair of side walls 22, 23 supported by the base. In the present embodiment, the housing also preferably includes a first locking member in the form of a notch or key hole 24*a* disposed in the base, adjacent an upper edge 26 thereof (FIGS. 1, 3 and 5). The notch 24*a* is preferably sized to receive a corresponding tab 28*a* supported on the hanger 16 in order to lock the box assembly in the closed position, as described in further detail below. The lid preferably includes a top 30, a pair of side walls 32, 33, a spine or rear wall 34, and a bottom extension 36 (See FIG. 4). In the present embodiment, the lid further includes a second locking member also in the form of a notch or key hole 24*b* disposed in the bottom extension 36, adjacent an upper edge 38 thereof (FIGS. 1 and 5). The notch 24*b* is also preferably sized to receive a corresponding tab 28*b* supported on the hanger 16. In the present embodiment, the tabs 28*a*, 28*b* may each include a post 29*a*, 29*b* supporting a head 31*a*, 31*b* having a diameter larger than that of the posts (FIGS. 10 & 11). Notches 24*a*, 26*b* may have the shape of a key hole including openings 33*a*, 33*b* having a first diameter sized to receive the heads of the tabs. The key hole may further include slots 35*a*, 35*b* extending from the openings 33*a*, 33*b* which have a narrower width than the diameter of the openings in order to lock the posts 29*a*, 29*b* therein. Alternately, the tabs and slots may take other forms, as would be known to those of skill in the art.

The housing 12 and lid 14 are preferably made of a hard, plastic material and may be either transparent or opaque. However, it is preferred that at least the top 30 of the lid be transparent so that items supported within the box are visible. As illustrated, the housing and lid may be separate pieces, with the lid being rotatable along an axis of rotation "y" so as to move between an open (FIG. 3) and closed (FIG. 2) position. In the present embodiment, the lid preferably includes a pair of openings 40, 42 disposed through side walls 32, 33, respectively. The openings 40, 42 are sized to receive corresponding protrusions 44, 46 supported on an inner surface of the side walls 22, 23 of the box so that the lid is rotatable between the open and closed positions along the axis of rotation "y". Other methods of rotatably attaching the lid and housing may be utilized, as would be known to those of skill in the art. As best shown in FIGS. 5–8, as the lid is rotated about axis "y", the back extension 36 moves from an open position where it lies substantially in a plane parallel and spaced from the base 18 of the housing (FIGS. 5 & 6), to a position where it lies in a plane substantially perpendicular to the base, and finally (FIG. 7), to the closed position where it lies in the same plane as the base. When the back extension and base are in the same plane, likewise the notches 24*a*, 24*b* are also in the same plane, such that the locking hanger can be easily attached to the housing in the closed position. Once the tabs 28*a*, 28*b* are received within the notches 24*a*, 24*b* and slid into the locked position the lid 14 is prevented from rotation about the "y" axis. In this manner, the lid is secured to the housing and the box assembly is locked. Once locked, a sticker may be placed over the rear of the hanger in order to conceal the locking mechanism. The sticker may include information relating to the product and may also include an electronic sensor. Alternately, an electronic sensor may be placed within the box assembly.

Figure 13:
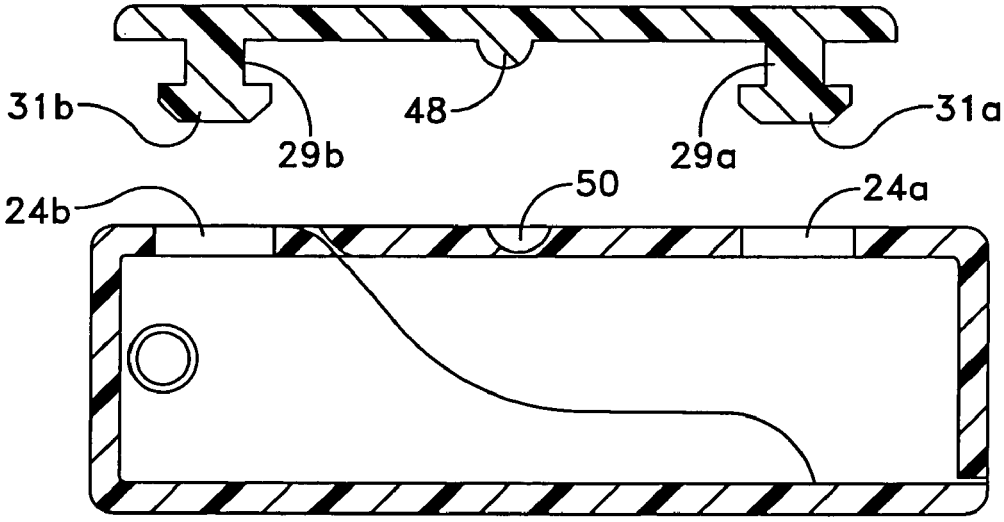
FIG. 13 is a cross-sectional view taken along lines 13—13 of FIG. 12.
Figure 14:
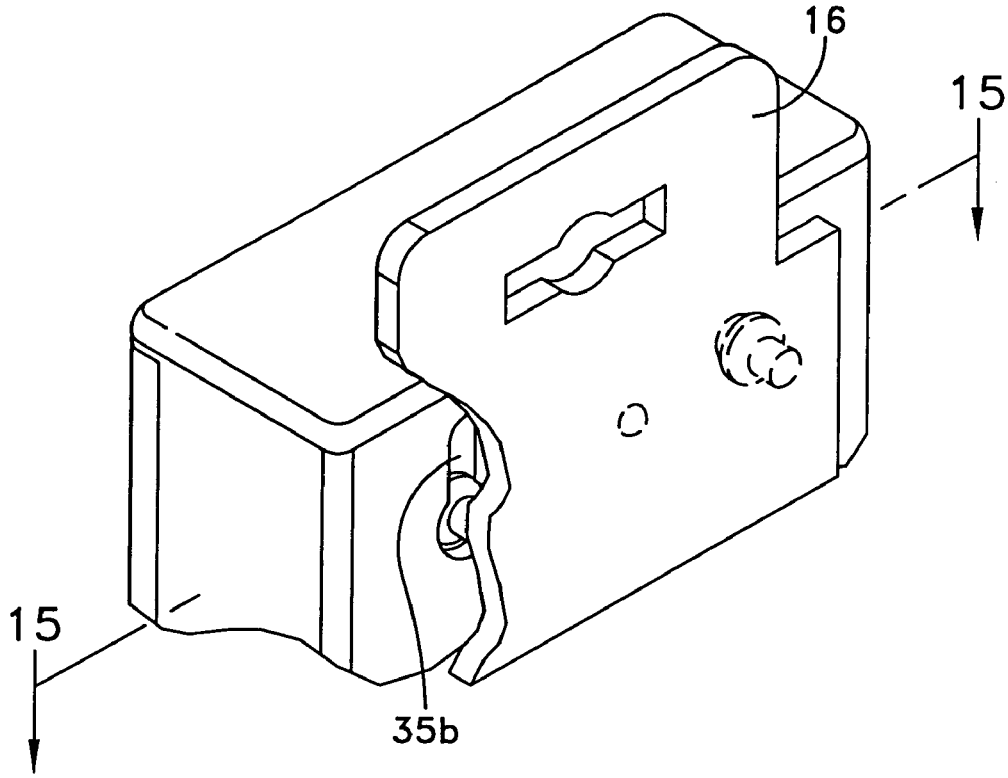
FIG. 14 is an enlarged, rear perspective view, partially broken away of the locking hanger being inserted into the housing and lid.
Figure 15:
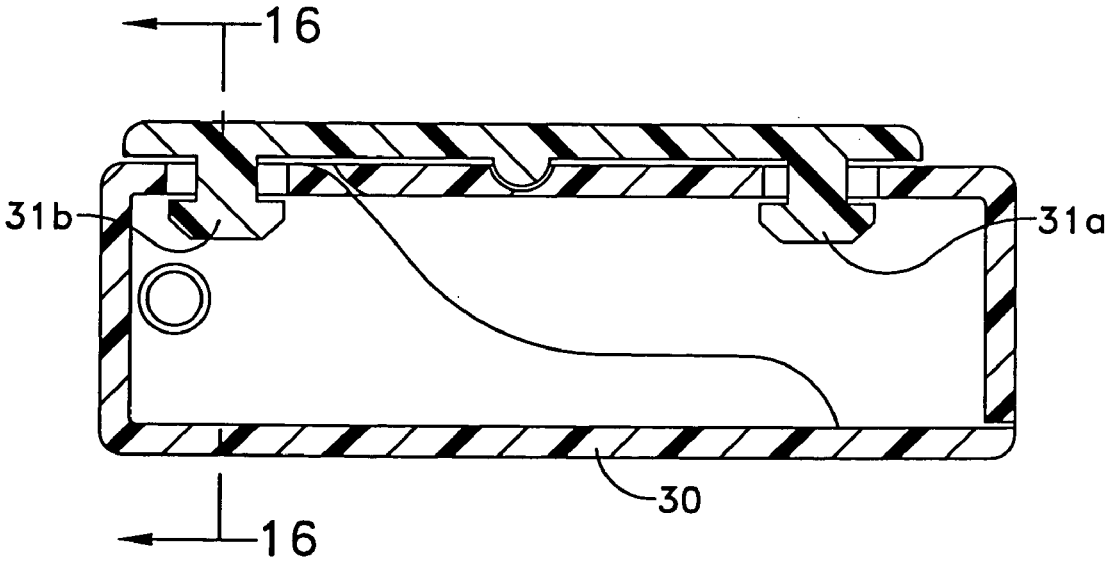
FIG. 15 is a cross-sectional view taken along lines 15—15 of FIG. 14.
Figure 16:
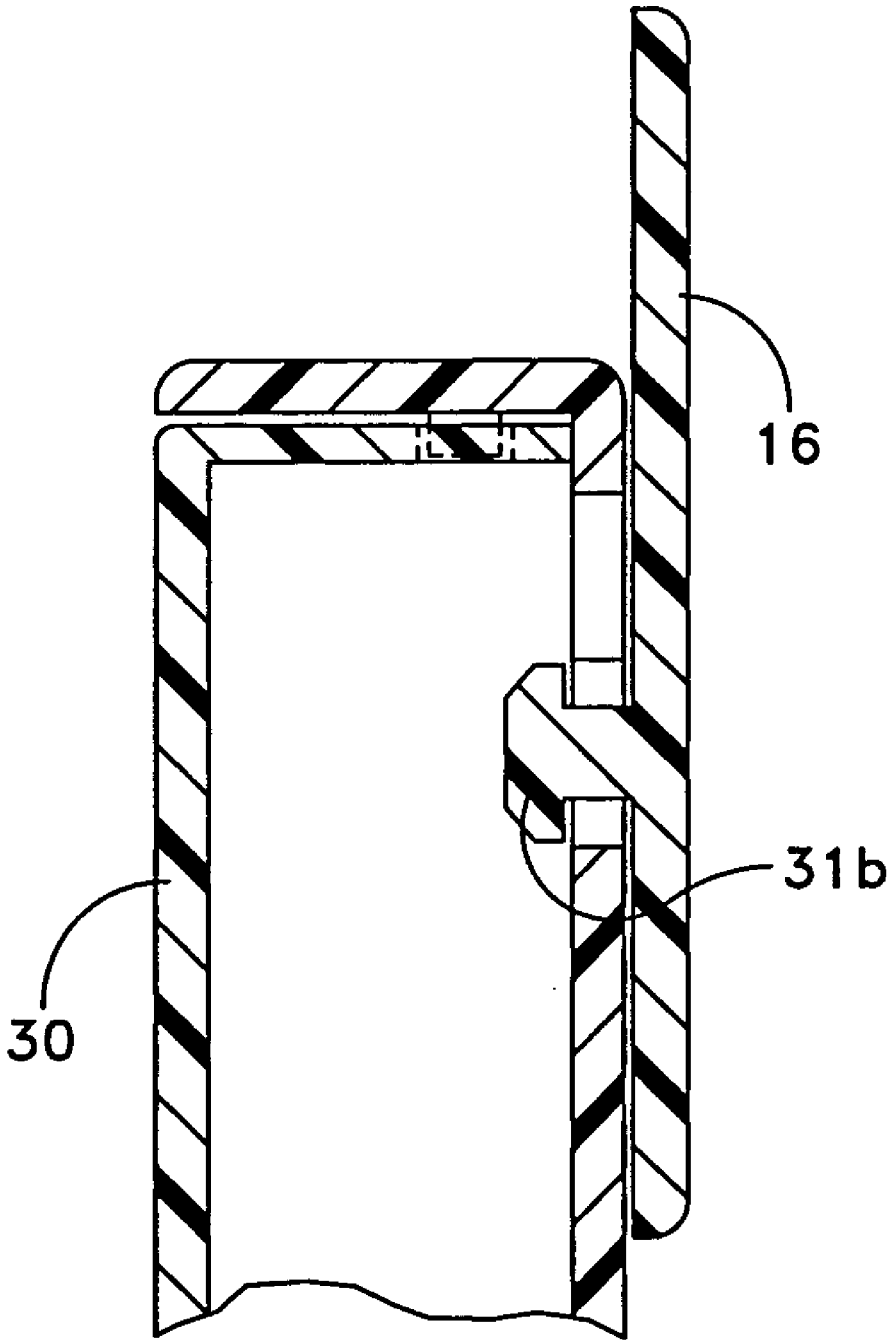
FIG. 16 is a cross-sectional view taken along lines 16—16 of FIG. 15.
Figure 17:
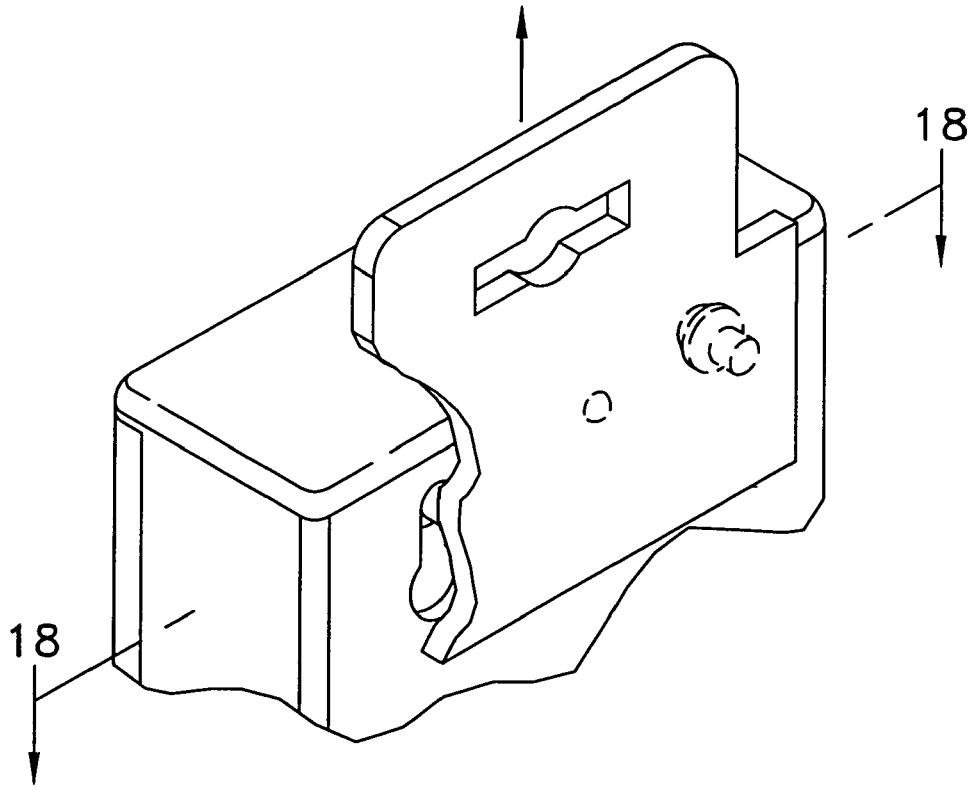
FIG. 17 is an enlarged, rear perspective view, partially broken away of the locking hanger and housing in the locked position.
Figure 18:
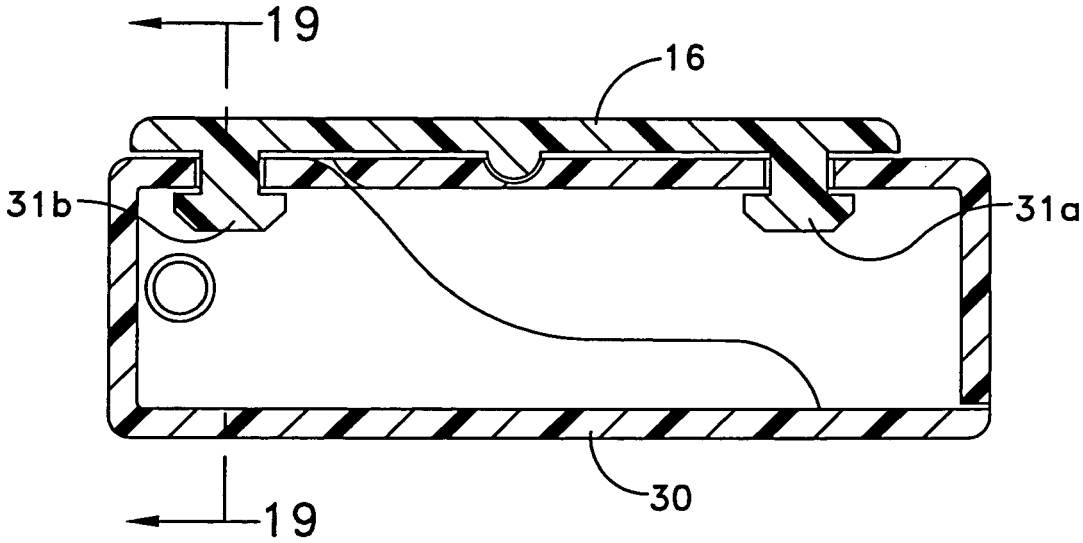
FIG. 18 is a cross-sectional view taken along lines 18—18 of FIG. 17.
Figure 19:
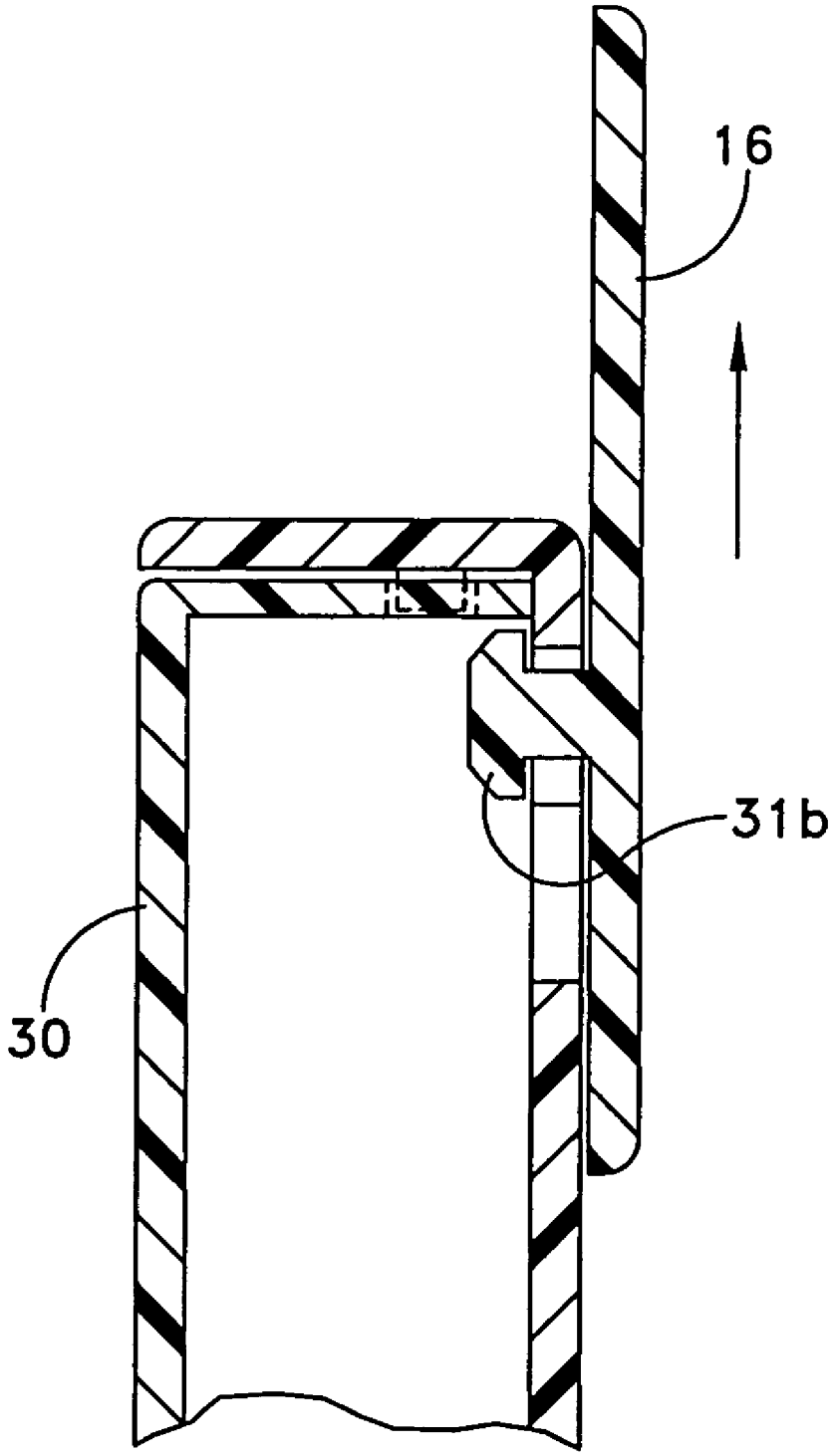
FIG. 19 is a cross-sectional view taken along lines 19—19 of FIG. 18.

The housing and the locking hanger may further include cooperating locating members 48, 50 as best shown in FIG. 13. The locating members further aid in locating the tabs of the locking hanger relative to the notches of the lid and housing. In the present embodiment, the locating member 48 is a protrusion, while member 50 is an indentation, although other style locating members may be utilized as would be known to those of skill in the art.

Use of the display box assembly 10 will now be described with reference to the drawings.

In use, the box assembly 10 is initially in an unlocked or open position where the interior of the housing is accessible. A product is then removably secured to the interior of the housing, in any desired manner. For example, a card supporting the item may be inserted within the housing. Upon securing the product within the housing the lid may be moved into the closed position in order to enclose the product. Alternately, an electronic sensor may first be placed within the housing before moving the lid into the closed position. In either case, the lid is rotated about the axis of rotation "y" such that the back extension 36 moves from an open position where it lies substantially in a plane parallel and spaced from the base 18 of the housing (FIGS. 5 & 6), to a position where it lies in a plane substantially perpendicular to the base, and finally (FIG. 7), to the closed position where it lies in the same plane as the base. As the back extension is moving, so too is the top 30 of the lid. The top 30 of the lid moves from the open position where it lies in a plane slightly offset and parallel to the plane of the base 18 of the housing, to a plane substantially perpendicular to the base, and finally to a plane parallel and spaced from the base. When the lid is in the closed position, the locking hanger can be attached to the housing by inserting the heads 31*a*, 31*b* of the tabs through openings 33*a*, 33*b*, and then sliding the posts 29*a*, 29*b* into the reduced diameter slots 35*a*, 35*b* so as to lock the box assembly in the closed position by preventing the lid 14 from rotation about the "y" axis. Once locked, a sticker may be placed over the rear of the hanger in order to conceal the locking mechanism. Once closed, the hanger may be used to display the box from a support, for example a rod.

It will be understood that various modifications may be made to the embodiments disclosed herein. For example, it should be understood that the lid and housing may be unitary in construction, that the shape may be other than rectangular, that the locking hanger may be a locking member and not include a hanger if display is in a case, and that any suitable material may be utilized for the box assembly. In addition, the tabs and slots of the locking members may be reversed, i.e. the tabs on the lid and housing and the slots on the locking hanger. Therefore, the above description should not be construed as limiting, but merely as exemplifications of preferred embodiments. Those skilled in the art will envision other modifications within the scope, spirit and intent of the invention.

What is claimed is:

1. A display box assembly comprising:

a housing constructed and arranged to display a product and including a base supporting a first locking member;

a lid supporting a second locking member, the lid being rotatable in an unlocked state between an opened and a closed position with respect to the housing;

a locking hanger including a third locking member and a fourth locking member;

wherein in a locked position one of the third and fourth locking members engages the first locking member of the housing and the other of the third and fourth locking members engages the second locking member of the lid such that the lid remains in the closed position and is not rotatable until the locking hanger is disengaged;

said lid further including a top, a pair of side walls, a rear wall, and a bottom extension that extends from the rear wall;

said second locking member being supported on the bottom extension of the lid; and said first and second locking members comprising slots and said third and fourth locking members comprising tabs constructed and arranged to engage the slots, wherein said tabs include a post supporting a head and wherein said slots include an opening sized to receive the head and a reduced diameter slot extending from the opening sized to engage the post in the locked position.

2. A display box assembly comprising:

a housing constructed and arranged to display a product and including a base supporting a first slot;

a lid supporting a second slot, the lid being rotatable in an unlocked state between an opened and a closed position with respect to the housing;

a locking hanger supporting a first tab and a second tab wherein in a locked position the first tab engages the first slot and the second tab engages the second slot such that the lid remains in the closed position and is not rotatable until the locking hanger is disengaged;

said lid further including a top, a pair of side walls, a rear wall, and a bottom extension that extends from the rear wall; and said second locking member being supported on the bottom extension of the lid, wherein the first and second tabs each include a post supporting a head, and wherein the first and second slots each include an opening sized to receive the head and a reduced diameter slot extending from the opening sized to engage the post in the locked position.

3. A display box assembly comprising:

a base member;

a lid member, pivot means connecting said base and lid members whereby said lid member may selectively be swung to an open or closed position;

said lid member having a wall section that is co-planar with a wall section of said base member when said lid member is in its closed position; and locking means releasably connected to said co-planar sections and extending from one section to the other, whereby when said locking means is in its operative connected position, said lid member is prevented from swinging to its open position, said locking means comprising a plate-like element having a pair of spaced tabs releasably engageable with a pair of openings, one of which is located on each co-planar wall section, said tabs each consisting of a headed stud, said openings each having a reverse keyhole configuration, the head portions of said studs being receivable within the larger portion of the opening, whereby downward sliding movement of said plate-like element causes said studs to move upwardly into the narrower portions of the openings, in which position said head portions retain the plate-like element assembled to the box to achieve the desired locking thereof.

* * * * *